US010576765B2

(12) United States Patent
Brown et al.

(10) Patent No.: US 10,576,765 B2
(45) Date of Patent: Mar. 3, 2020

(54) PRINTER DOOR HINGE ASSEMBLY

(71) Applicant: Hewlett-Packard Development Company, L.P., Houston, TX (US)

(72) Inventors: Steve Brown, Vancouver, WA (US); Kevin Lo, Vancouver, WA (US); Tod Kinsley, Vancouver, WA (US); Lynn A Collie, Battle Ground, WA (US); Peter G Hwang, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/067,281

(22) PCT Filed: Apr. 29, 2016

(86) PCT No.: PCT/US2016/030272
§ 371 (c)(1),
(2) Date: Jun. 29, 2018

(87) PCT Pub. No.: WO2017/189016
PCT Pub. Date: Nov. 2, 2017

(65) Prior Publication Data

US 2019/0023041 A1 Jan. 24, 2019

(51) Int. Cl.
*B41J 29/02* (2006.01)
*B41J 29/13* (2006.01)
(Continued)

(52) U.S. Cl.
CPC ..... *B41J 29/13* (2013.01); *B41J 29/02* (2013.01); *E05D 3/14* (2013.01); *E05D 11/00* (2013.01); *E05Y 2900/606* (2013.01)

(58) Field of Classification Search
CPC .. B41J 2/17509; B41J 2/1752; B41J 2/17555; B41J 29/02; B41J 29/13; E05D 3/14; E05D 11/00; E05Y 2900/606
See application file for complete search history.

(56) References Cited

U.S. PATENT DOCUMENTS 5,047,801 A * 9/1991 Haneda ..... G03G 15/01 399/112
5,365,315 A * 11/1994 Baker ..... G03G 21/1832 399/111
(Continued)

FOREIGN PATENT DOCUMENTS

CN 102900293 1/2013
CN 10349331 1/2014
(Continued)

OTHER PUBLICATIONS

Epson Manual ~ Unpacking and Assembling the printer ~ 2016 ~ 32 pages.

*Primary Examiner* — Anh T Vo
(74) *Attorney, Agent, or Firm* — Dicke Billig & Czaja PLLC

(57) ABSTRACT

A printer includes a housing, a print engine within the housing, a door to cover a portion of the housing, and a hinge assembly coupled to the housing and the door to support the door in a closed position to cover the portion of the housing and an open position to uncover the portion of the housing, wherein, in the open position, the door is offset from the housing by the hinge assembly.

16 Claims, 8 Drawing Sheets

(51) Int. Cl.
*E05D 3/14* (2006.01)
*E05D 11/00* (2006.01)

(56) References Cited

U.S. PATENT DOCUMENTS

| | | | | |
|---|---|---|---|---|
| 5,752,135 | A | 5/1998 | Coffey et al. | |
| 6,011,935 | A * | 1/2000 | Matsuzaka | G03G 21/1889 399/111 |
| 7,162,182 | B2 | 1/2007 | Tonges et al. | |
| 9,216,867 | B2 | 12/2015 | Aoyama | |
| 2003/0081018 | A1 | 5/2003 | Kinsley et al. | |
| 2005/0157150 | A1 * | 7/2005 | Silverbrook | B41J 29/13 347/108 |
| 2006/0002735 | A1 * | 1/2006 | Tamaru | G03G 15/01 399/111 |
| 2006/0147224 | A1 | 7/2006 | Hatama | |
| 2009/0085993 | A1 | 4/2009 | Silverbrook et al. | |
| 2012/0318083 | A1 | 12/2012 | Hsu | |
| 2013/0038190 | A1 | 2/2013 | Lin | |
| 2016/0089893 | A1 | 3/2016 | Osakabe et al. | |

FOREIGN PATENT DOCUMENTS

| | | | |
|---|---|---|---|
| EP | 1527896 | A1 | 5/2005 |
| JP | 2001205895 | | 7/2001 |
| JP | 2005292438 | | 10/2005 |
| JP | 2013054183 | | 3/2013 |
| JP | 2015028610 | | 2/2015 |
| WO | WO-0108890 | A1 | 2/2001 |

* cited by examiner

PRINTER DOOR HINGE ASSEMBLY

BACKGROUND

A printer, including, for example, an inkjet printer, a laser printer, a 3-D printer, or other type of printer, may include a door (panel or cover) to selectively conceal and reveal an interior or opening of the printer. Opening of the door may extend the door well beyond a footprint of the printer and/or may reveal components which should remain concealed.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure.

Figure 1A:
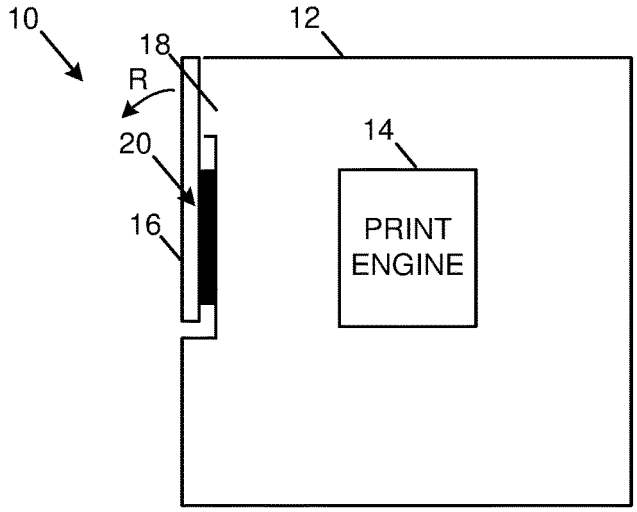
FIGS. 1A, 1B, and 1C are schematic illustrations of one example of a portion of a printer.
Figure 1B:
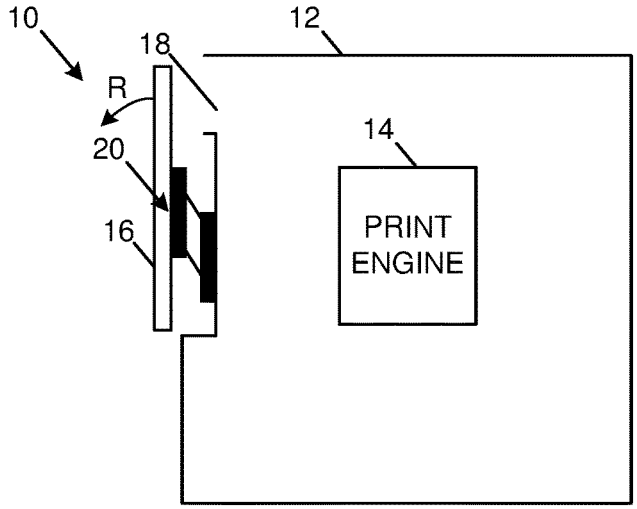
Figure 1C:
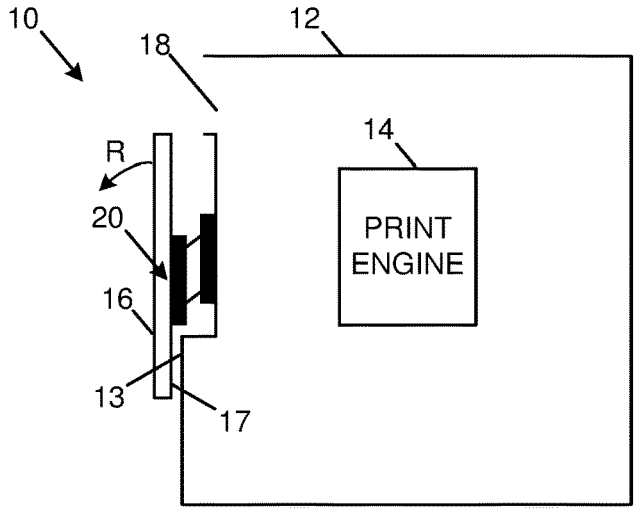

FIGS. 1A, 1B, and 1C are schematic illustrations of one example of a portion of a printer 10. In one implementation, printer 10 includes a housing 12 and a print engine 14 within housing 12 for producing printed output. Printer 10 can be an inkjet printer, a laser printer, a 3-D printer, or other type of printer or a multi-function device including, for example, a combination of two or more of a printer, a scanner, a copier, and/or a fax machine.

In one implementation, printer 10 includes a door (panel or cover) 16 which is secured to and covers a portion of housing 12 and is selectively opened to expose and closed to conceal an opening (or interior) 18 of housing 12. In one example, opening 18 includes a cavity, bay, pocket, receptacle, recess, or other open space formed in and/or extended into housing 12.

In one implementation, door 16 is positionable over opening 18 and selectively moved to reveal and cover opening 18. In one example, opening 18 receives or allows access to one or more than one removable or replaceable print cartridges for print engine 14, and door 16 is opened to allow access to opening 18 for installation and removal of the print cartridges.

In one implementation, printer 10 includes a hinge assembly 20 to support door 16 and reposition or move door 16 to selectively reveal and conceal opening 18. More specifically, hinge assembly 20 is operable to move door 16 between a closed position in which opening 18 is concealed, as illustrated for example in FIG. 1A, and an open position in which opening 18 is revealed, as illustrated for example in FIG. 1C. In one implementation, in moving door 16 between the closed position and the open position, hinge assembly 20 moves door 16 through at least one intermediate position as illustrated, for example, in FIG. 1B. In one example, in moving door 16 from the closed position to the open position, hinge assembly 20 moves door 16 away from housing 12 and down, as illustrated by arrow R.

In one implementation, hinge assembly 20 maintains an orientation of door 16 relative to housing 12 as door 16 is moved between the closed position and the open position (including from the closed position to the open position, and from the open position to the closed position). For example, as door 16 is moved relative to housing 12, door 16 (including a top of door 16 and a bottom of door 16) is spaced away from or offset from housing 12. More specifically, in one implementation, as door 16 is moved relative to housing 12, hinge assembly 20 maintains a parallel orientation of door 16 relative to housing 12 such that a top of door 16 and a bottom of door 16 are each equally spaced from a common surface of housing 12. As such, in the open position, a backside or surface 17 of door 16 (e.g., a side or surface to which hinge assembly 20 is secured) is spaced and offset from and oriented substantially parallel with a front side or surface 13 of housing 12 (e.g., a side or surface to which hinge assembly 20 is secured) such that backside or surface 17 of door 16 faces front side or surface 13 of housing 12.

Figure 2A:
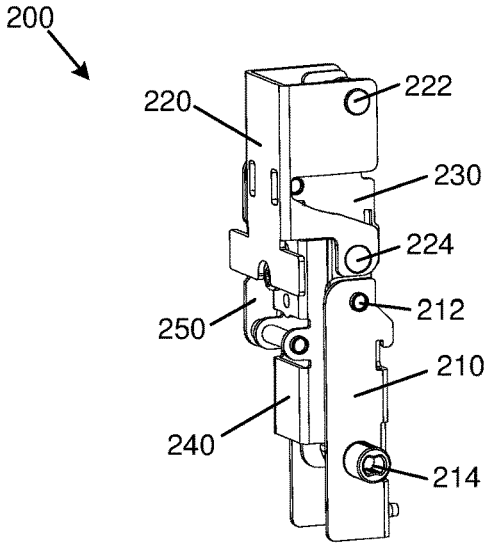
FIGS. 2A, 2B, and 2C illustrate one example of a hinge assembly for a door of a printer in different orientations.
Figure 2B:
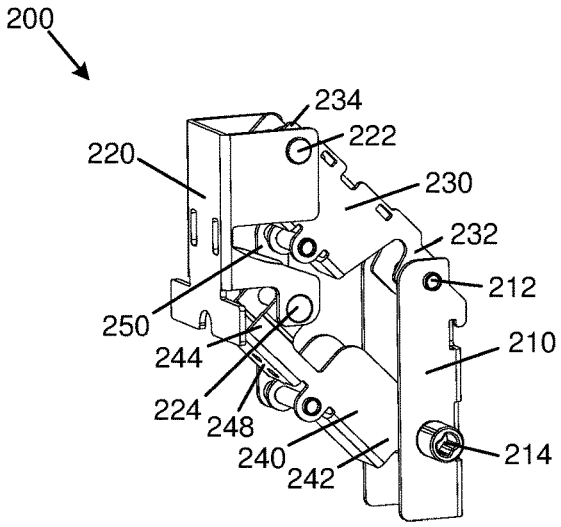
Figure 2C:
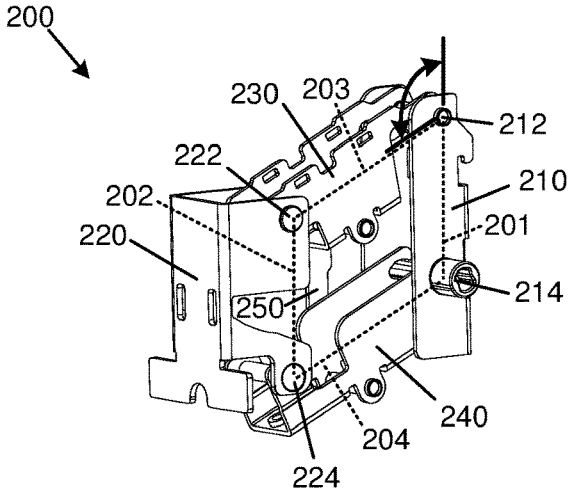

FIGS. 2A, 2B, and 2C illustrate one example of a hinge assembly 200 for a door (panel or cover) of a printer, such as hinge assembly 20 for door 16 of printer 10 (FIGS. 1A, 1B, 1C). In one implementation, hinge assembly 200 includes a first support 210 to be coupled to a housing of a printer, such as housing 12 of printer 10, a second support 220 to be coupled to a door of the printer, such as door 16 of printer 10, a first arm 230 pivotally connected to and extended between first support 210 and second support 220, and a second arm 240 pivotally connected to and extended between first support 210 and second support 220. In one example, first arm 230 provides an upper pivotable arm of hinge assembly 200 and second arm 240 provides a lower pivotable arm of hinge assembly 200. As such, first support 210 is fixed and second support 220 is pivotable relative to first support 210 by and about first arm 230 and second arm 240.

In one implementation, first arm 230 is joined to first support 210 with a first rotatable joint 212 and joined to second support 220 with a second rotatable joint 222, and second arm 240 is joined to first support 210 with a third rotating joint 214 and joined to second support 220 with a fourth rotating joint 224. More specifically, in one implementation, a first end 232 of first arm 230 is joined to first support 210 at first rotatable joint 212 and a second end 234 of first arm 230 is joined to second support 220 at second rotatable joint 222. In addition, a first end 242 of second arm 240 is joined to first support 210 at third rotatable joint 214 and a second end 244 of second arm 240 is joined to second support 220 at fourth rotatable joint 224. As such, first rotatable joint 212, second rotatable joint 222, third rotatable joint 214, and fourth rotatable joint 224 each have one-degree of freedom.

As illustrated in the example of FIGS. 2A, 2B, and 2C, hinge assembly 200 comprises a four-bar linkage, with first support 210 defining a first link 201, second support 220 defining a second link 202, first arm 230 defining a third link 203, and second arm 240 defining a fourth link 204. In one example, first link 201 and second link 202 are substantially parallel with each other and third link 203 and fourth link 204 are substantially parallel with each other such that hinge assembly 200 comprises a parallel four-bar linkage. As such, hinge assembly 200 maintains parallelism between first support 210 and second support 220 (and first arm 230 and second arm 240) during movement of second support 220 relative to first support 210 between a closed position of hinge assembly 200, as illustrated in the example of FIG. 2A, and an open position of hinge assembly 200, as illustrated in the example of FIG. 2C.

In one example, hinge assembly 200 is pivotable through an angle A between a closed position and an open position. In one implementation, angle A is approximately 115 degrees. For example, at the closed position, as illustrated for example in FIG. 2A, first arm 230 and second arm 240 are oriented at an angle of approximately 0 degrees relative to first support 210 and, at the open position, as illustrated for example in FIG. 2C, first arm 230 and second arm 240 are oriented at an angle of approximately 115 degrees relative to first support 210. In one implementation, between the closed position and the open position, hinge assembly 200 moves through a number of intermediate positions, including different angles of orientation. For example, as illustrated in the example of FIG. 2B, first arm 230 and second arm 240 are oriented at an angle of approximately 45 degrees relative to support 210 as hinge 200 moves between the closed position and the open position.

In one example, a toe link 250 extends between first arm 230 and second arm 240. In one implementation, toe link 250 is pivotally connected to an intermediate portion of first arm 230 and an intermediate portion of second arm 240. By extending between and being pivotally connected to first arm 230 and second arm 240, toe link 250 helps to guide motion of hinge assembly 200 as hinge assembly is moved between a closed position and an open position.

Figure 3:
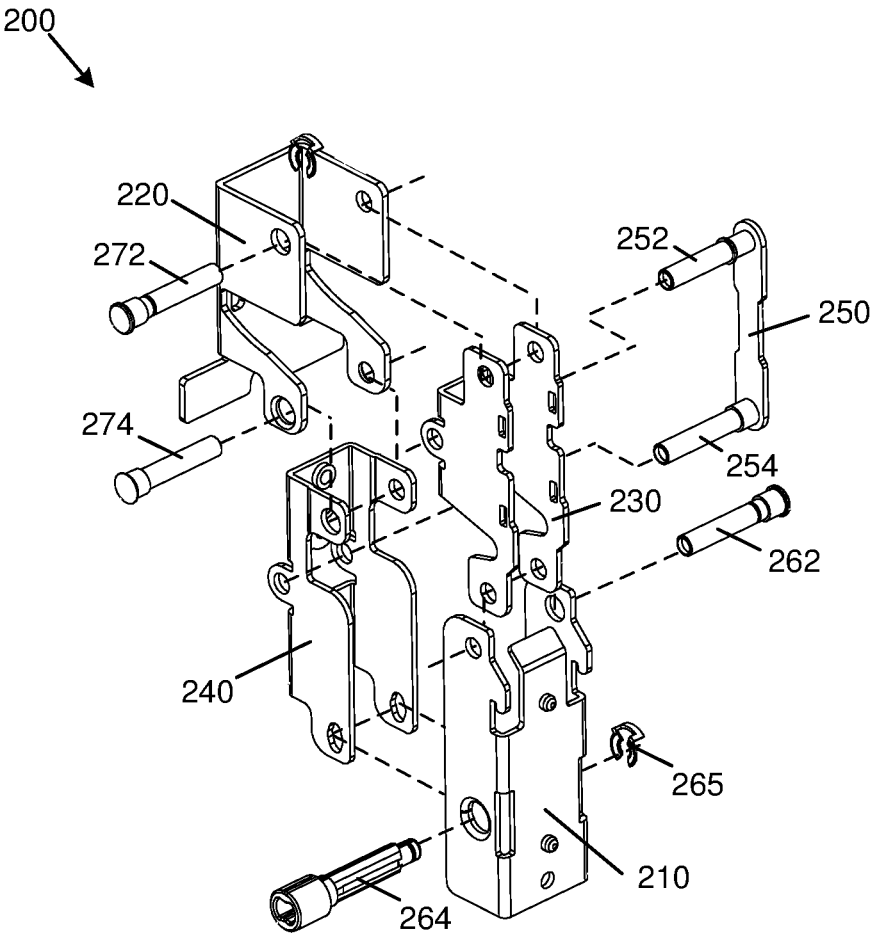
FIG. 3 is an exploded view of the example hinge assembly of FIGS. 2A, 2B, and 2C.

In one implementation, as illustrated in the example of FIG. 3, hinge assembly 200 includes a first pin 262 which pivotally connects first arm 230 and first support 210 to establish first rotatable joint 212 (e.g., FIG. 2B), a second pin 272 which pivotally connects first arm 230 and second support 220 to establish second rotatable joint 222 (e.g., FIG. 2B), a third pin 264 which pivotally connects second arm 240 and first support 210 to establish third rotatable joint 214 (e.g., FIG. 2B), and a fourth pin 274 which pivotally connects second arm 240 and second support 220 to establish fourth rotatable joint 224 (e.g., FIG. 2B). In one implementation, third pin 264 (with a retainer clip 265) comprises a torque damper pin to control rotation of third rotatable joint 214 and, therefore, control (i.e., dampen or slow) rotation of hinge assembly 200 so as to control (i.e., slow) motion of an attached door as the door is opened (i.e., prevent banging). In some examples, springs (as attached, for example, to the door and the housing of the printer) may be used to reduce the effective weight of the door as the door is opened so as to help in opening of the door.

In addition, as illustrated in the example of FIG. 3, toe link 250 includes a first pin 252 and a second pin 254 which pivotally connect toe link 250 to first arm 230 and second arm 240, respectively. By coupling first and second support arms 230 and 240 with first and second supports 210 and 220 with pins 262, 264, 272, and 274, and coupling toe-link 250 with first and second support arms 230 and 240 with first and second pins 252 and 254, self-binding is prevented or reduced during motion of hinge assembly 200.

Figure 4A:
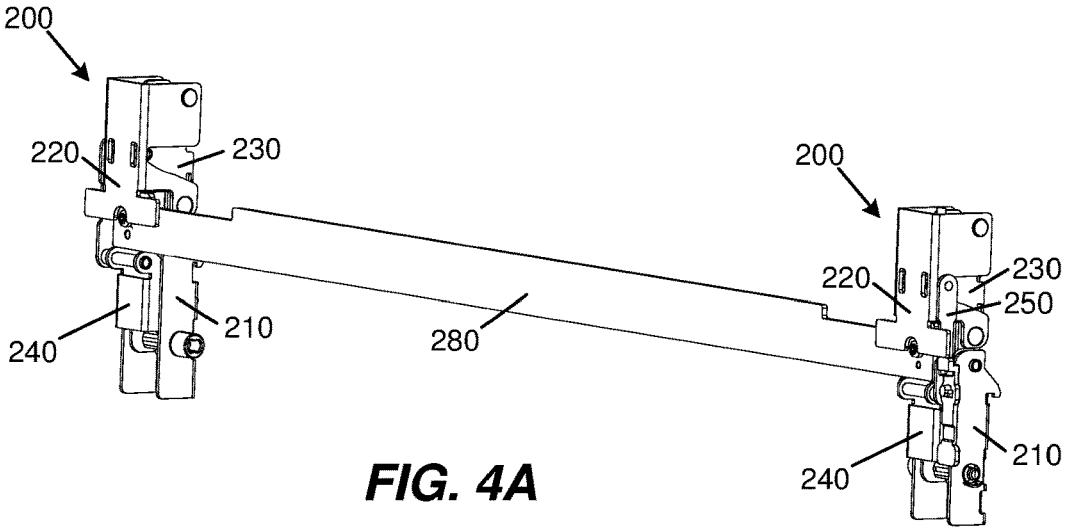
FIGS. 4A, 4B, and 4C illustrate one example of a pair of the hinge assemblies of FIGS. 2A, 2B, and 2C.
Figure 4B:
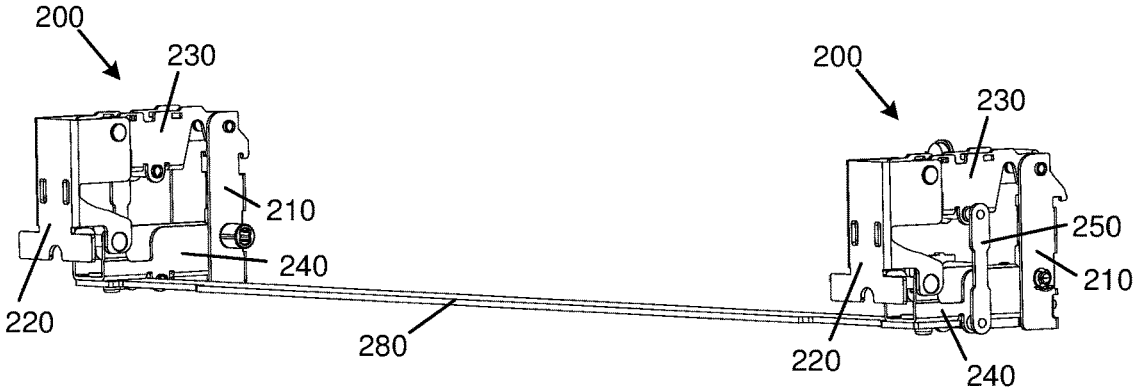
Figure 4C:
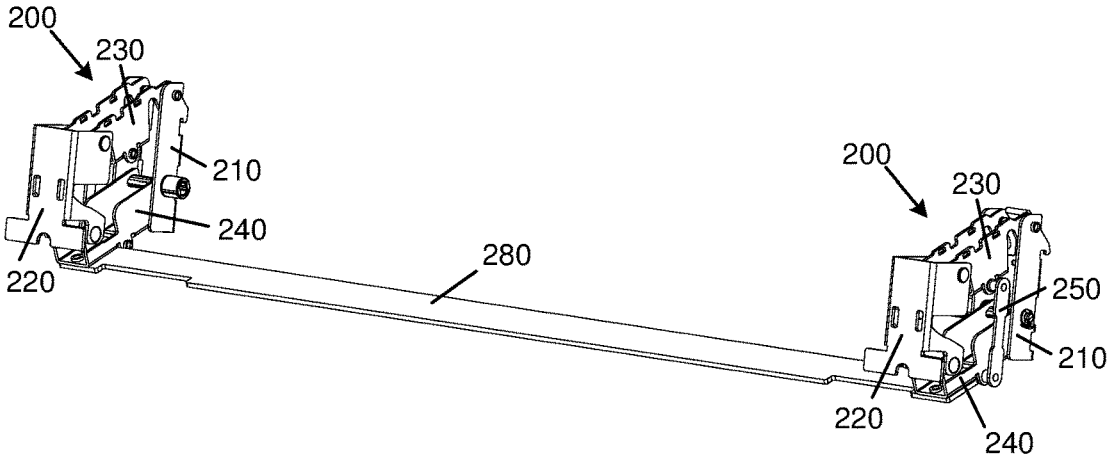

In one implementation, as illustrated in the example of FIGS. 4A, 4B, and 4C, a pair of hinge assemblies 200 (each including first support 210, second support 220, first arm 230, second arm 240, and toe link 250) are provided to support a door (panel or cover) of a printer, such as door 16 of printer 10 (FIGS. 1A, 1B, 1C). In one example, hinge assemblies 200 are spaced apart from each other with a cross-bar 280 extended between hinge assemblies 200 such that cross-bar 280 helps to synchronize movement of spaced hinge assemblies 200. In one implementation, cross-bar 280 is secured to second arm 240 of each of the hinge assemblies 200 (e.g., at an attach area 248 (FIG. 2B)) such that cross-bar 280 rotates with second arm 240 as hinge assemblies 200 move between a closed position, as illustrated for example in FIG. 4A, and an open position, as illustrated for example in FIG. 4C, including through an intermediate position, as illustrated for example in FIG. 4B.

Figure 5:
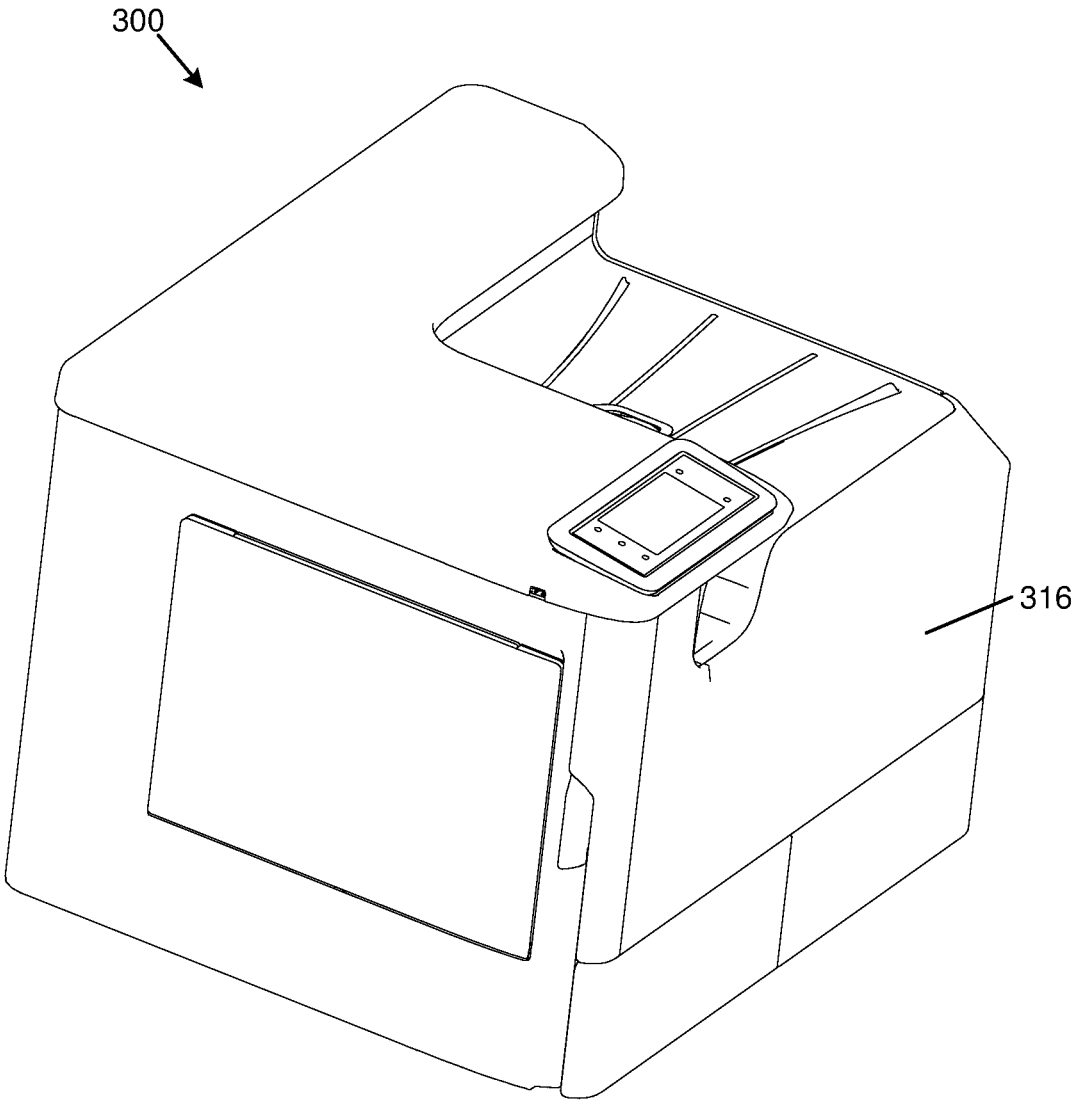
FIG. 5 illustrates one example of a printer including a door in a closed position as supported by the hinge assemblies in the orientation of FIG. 4A.
Figure 6:
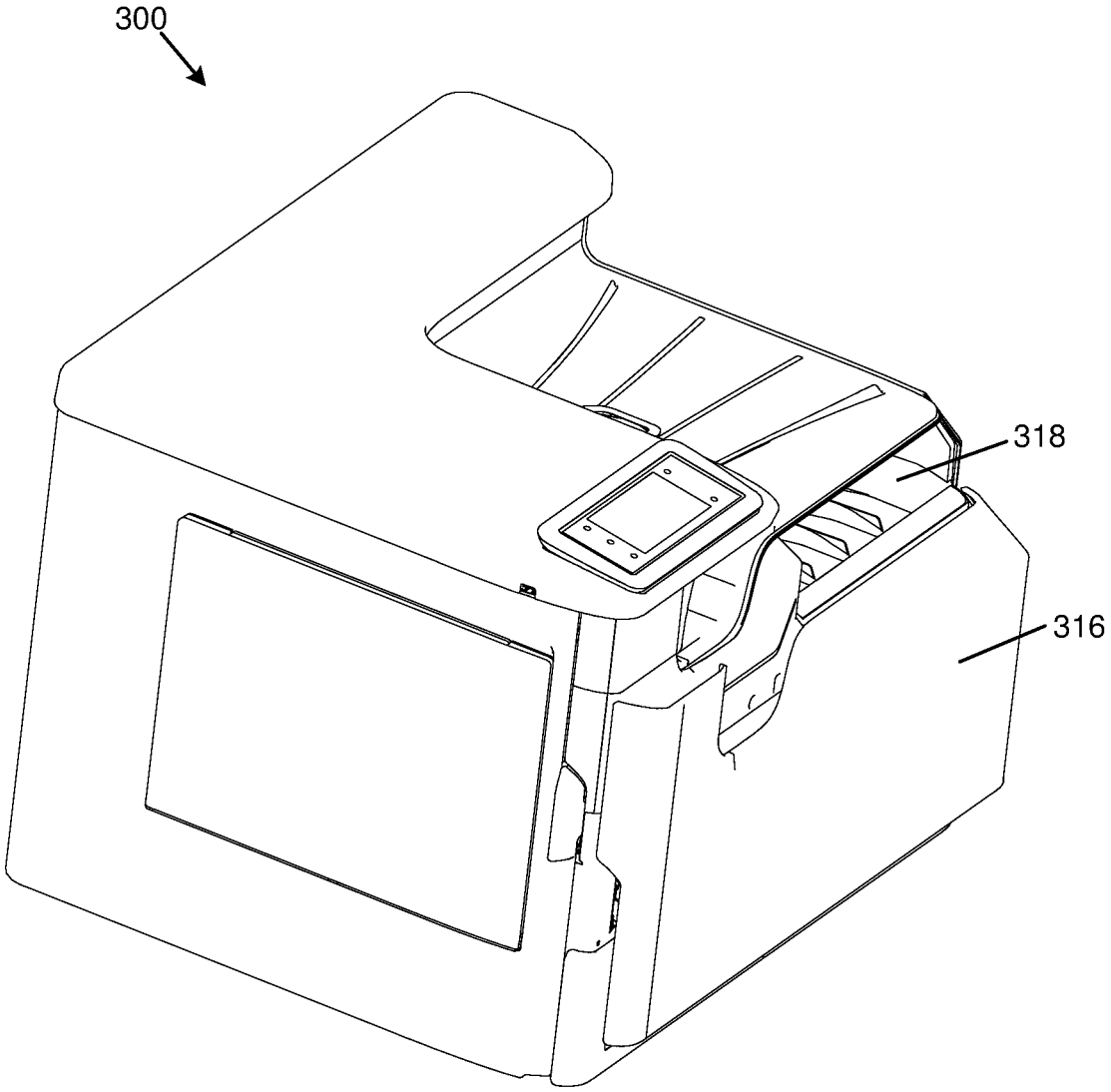
FIG. 6 illustrates the printer of FIG. 5 with the door in an open position as supported by the hinge assemblies in the orientation of FIG. 4C.

FIGS. 5 and 6 illustrate one example of a printer 300 with a door (panel or cover) 316 supported by hinge assemblies 200 (FIGS. 4A, 4B, 4C). More specifically, FIG. 5 illustrates door 316 in a closed position as supported by hinge assemblies 200 in the orientation of FIG. 4A, and FIG. 6 illustrates door 316 in an open position as supported by hinge assemblies 200 in the orientation of FIG. 4C. In one implementation, as illustrated in the example of FIG. 6, an opening 318 of printer 300 is revealed or exposed with door 316 in the open position.

Figure 7:
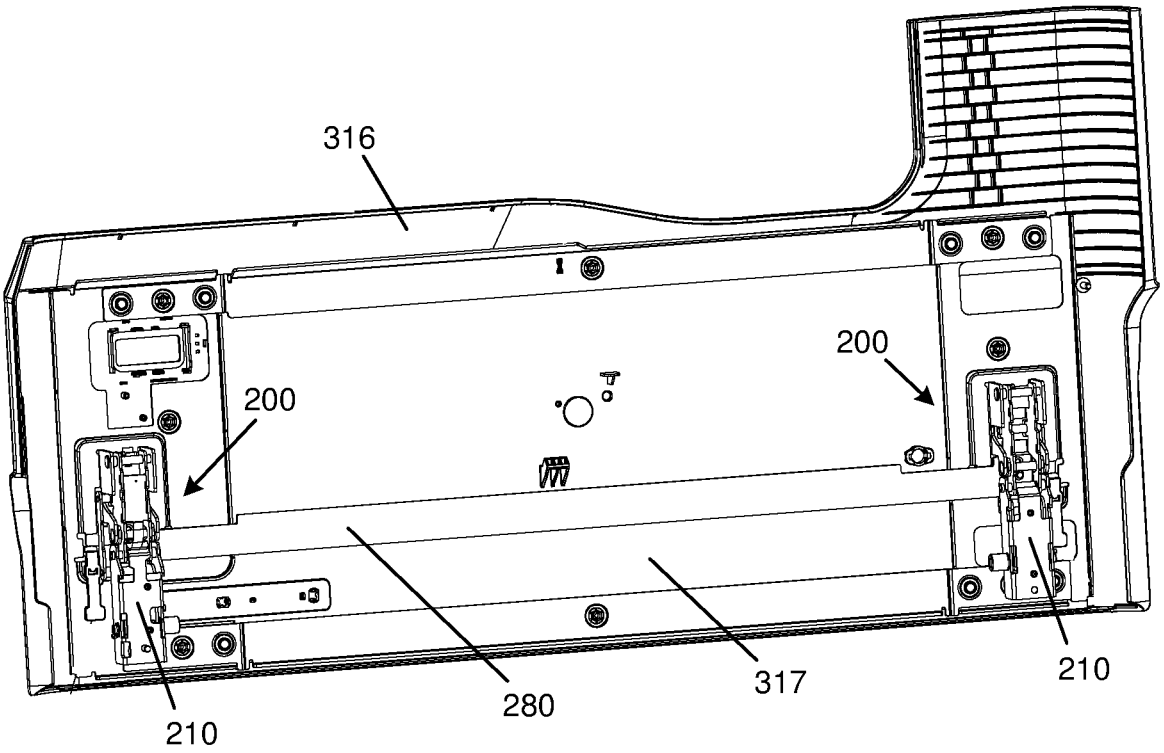
FIG. 7 illustrates one example of the door removed from the printer of FIG. 5 with the hinge assemblies in the orientation of FIG. 4A secured to the door.

FIG. 7 illustrates door 316 as removed from printer 300 with hinge assemblies 200 secured to a backside 317 of door 316 (so as to form part of a door assembly for a printer), and with hinge assemblies 200 in the orientation illustrated in FIGS. 2A and 4A (i.e., a closed position). More specifically, second support 220 of each hinge assembly 200 (with cross-bar 280 extending between hinge assemblies 200) is secured to backside 317 of door 316 (with first support 210 of each hinge assembly 200 exposed as to be secured or attached to printer 300).

Figure 8:
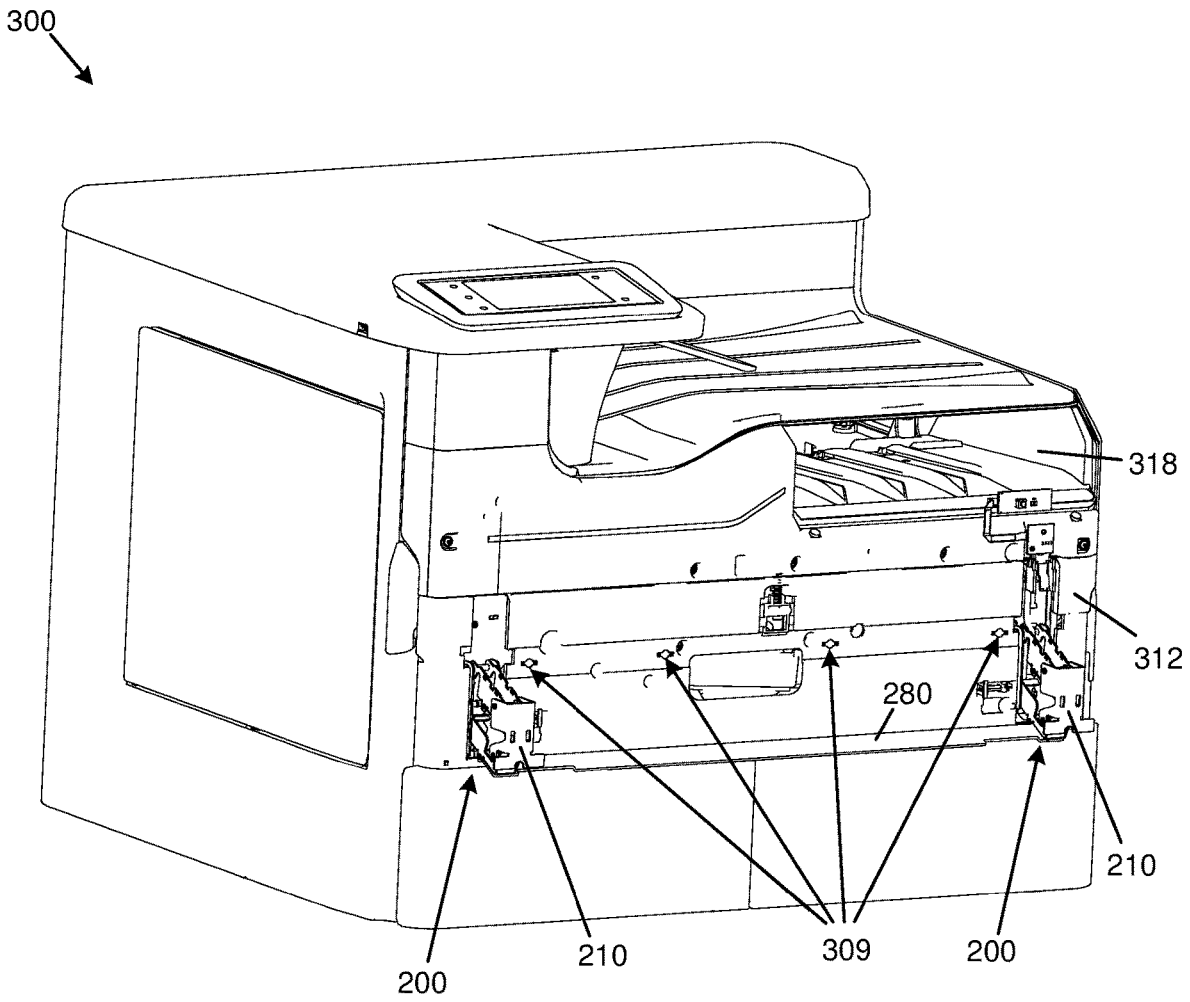
FIG. 8 illustrates one example of the printer of FIG. 6 with the door removed and the hinge assemblies in the orientation of FIG. 4C secured to a housing of the printer.

FIG. 8 illustrates printer 300 (with door 316 removed for illustration purposes and opening 318 exposed) with hinge assemblies 200 secured to a housing 312 of printer 300, and hinge assemblies 200 in the orientation illustrated in FIGS. 2C and 4C (i.e., open position). More specifically, first support 210 of each hinge assembly 200 (with cross-bar 280 extending between hinge assemblies 200) is secured to housing 312 of printer 300 (with second support 220 of each hinge assembly 200 exposed as to be secured or attached to door 316).

In one example, as illustrated in FIG. 8, printer 300 includes magnets 309 which are supported by housing 312 to attract cross-bar 280 (as extended between hinge assemblies 200) as hinge assemblies 200 (and door 316) are moved to a closed position, as illustrated for example in FIGS. 4A, 5 and 7. In other examples, a hook can be used to engage a spring-loaded snap inside the housing.

By supporting a door (panel or cover) of a printer with a hinge assembly (or hinge assemblies) as described and illustrated herein, internal components of the printer may be concealed while still allowing access to certain areas. With a hinge assembly (or hinge assemblies) as described and illustrated herein, the hinge assembly is less exposed, thereby providing a cleaner and safer design, and less internals of the printer are exposed, thereby limiting user access to components which should remain concealed and simplifying user interaction with the printer. With a hinge assembly (or hinge assemblies) as described and illustrated herein, opening (and closing) of the printer door utilizes less operational space, thereby enabling reduced product depth and reduced operational footprint of the printer.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein.

The invention claimed is:

1. A printer, comprising:

a housing;

a print engine within the housing;

a door to cover a portion of the housing; and a hinge assembly coupled to the housing and the door to support the door in a closed position to cover the portion of the housing and an open position to uncover the portion of the housing, wherein, in the open position, the door is offset from the housing by the hinge assembly, wherein the hinge assembly includes a first support secured to the housing, a second support secured to the door, a first arm pivotally connected to and extended between the first support and the second support, and a second arm pivotally connected to and extended between the first support and the second support, wherein the first arm and the second arm maintain parallelism between the first support and the second support during movement of the second support relative to the first support.

2. The printer of claim 1, wherein, in the open position, a backside of the door faces a front side of the housing.

3. The printer of claim 1, wherein, in the open position, a top of the door and a bottom of the door are each equally spaced from the housing.

4. The printer of claim 1, wherein, in the closed position and the open position, the hinge assembly maintains an orientation of the door relative to the housing.

5. The printer of claim 4, wherein the orientation of the door relative to the housing is substantially parallel.

6. A hinge assembly for a door of a printer, comprising:

a first support to be secured to a housing of the printer;

a second support to be secured to the door of the printer;

a first arm pivotally connected to and extended between the first support and the second support; and a second arm pivotally connected to and extended between the first support and the second support, wherein the first arm and the second arm maintain parallelism between the first support and the second support during movement of the second support relative to the first support.

7. The hinge assembly of claim 6, wherein the first arm and the second arm each rotate through an angle of approximately 115 degrees.

8. The hinge assembly of claim 6, wherein a first end of the first arm is joined to the first support at a first rotatable joint and a second end of the first arm is joined to the second support at a second rotatable joint, and wherein a first end of the second arm is joined to the first support at a third rotatable joint and a second end of the second arm is joined to the second support at a fourth rotatable joint, wherein the first rotatable joint, the second rotatable joint, the third rotatable joint, and the fourth rotatable joint each have one-degree of freedom.

9. The hinge assembly of claim 6, wherein the hinge assembly comprises a four-bar linkage, with the first support defining a first link, the second support defining a second link, the first arm defining a third link, and the second arm defining a fourth link.

10. The hinge assembly of claim 6, further comprising:

a toe link pivotally connected to and extended between the first arm and the second arm.

11. A door assembly for a printer, comprising:

a panel; and a pair of hinge assemblies spaced from each other and each secured to the panel, each of the hinge assemblies including a first arm to extend between the panel and a housing of the printer, and a second arm to extend between the panel and the housing of the printer, the first arm and the second arm to maintain parallelism of the panel relative to the housing of the printer as the panel is moved between a first position and a second position relative to the housing.

12. The door assembly of claim 11, wherein the orientation of the panel relative to the housing of the printer is substantially parallel.

13. The door assembly of claim 11, wherein the first position comprises a closed position of the door assembly and the second position comprises an open position of the door assembly.

14. The door assembly of claim 11, further comprising:

a cross-bar coupled to and extended between the hinge assemblies.

15. The door assembly of claim 14, wherein, with the panel in the first position, the cross-bar is magnetically mated with the housing of the printer.

16. The door assembly of claim 11, wherein each of the hinge assemblies further include a first support to be secured to the housing of the printer, and a second support to be secured to the panel, wherein the first arm of each of the hinge assemblies is pivotally connected to and extended between the first support and the second support of one of the hinge assemblies, and the second arm of each of the hinge assemblies is pivotally connected to and extended between the first support and the second support of one of the hinge assemblies.

* * * * *